US009869169B2

(12) United States Patent
Frederick et al.

(10) Patent No.: US 9,869,169 B2
(45) Date of Patent: Jan. 16, 2018

(54) METHOD TO MAINTAIN RESERVOIR PRESSURE DURING HYDROCARBON RECOVERY OPERATIONS USING ELECTRICAL HEATING MEANS WITH OR WITHOUT INJECTION OF NON-CONDENSABLE GASES

(71) Applicant: Husky Oil Operations Limited, Calgary (CA)

(72) Inventors: Lawrence J. Frederick, Calgary (CA); William Cody Wollen, Calgary (CA)

(73) Assignee: Husky Oil Operations Limited, Calgary, Alberta (CA)

( * ) Notice: Subject to any disclaimer, the term of this patent is extended or adjusted under 35 U.S.C. 154(b) by 364 days.

(21) Appl. No.: 14/564,724

(22) Filed: Dec. 9, 2014

(65) Prior Publication Data

US 2015/0167436 A1 Jun. 18, 2015

Related U.S. Application Data

(60) Provisional application No. 61/915,452, filed on Dec. 12, 2013.

(51) Int. Cl.

| | |
|---|---|
| ***E21B 43/24*** | (2006.01) |
| ***E21B 36/04*** | (2006.01) |
| ***E21B 43/18*** | (2006.01) |

(52) U.S. Cl.

CPC ..... *E21B 43/2408* (2013.01); *E21B 36/04* (2013.01); *E21B 43/18* (2013.01); *E21B 43/2406* (2013.01)

(58) Field of Classification Search

CPC ..... E21B 43/24–43/248; E21B 43/16–43/20; E21B 36/00–36/04; E21B 43/3405; E21B 43/305

(Continued)

(56) References Cited

U.S. PATENT DOCUMENTS

| | | | |
|---|---|---|---|
| 4,508,168 | A | 4/1985 | Heeren |
| 4,524,826 | A | 6/1985 | Savage |

(Continued)

FOREIGN PATENT DOCUMENTS

| | | |
|---|---|---|
| CA | 1164335 | 3/1984 |
| CA | 2492306 | 7/2006 |

(Continued)

*Primary Examiner* — George S Gray

(74) *Attorney, Agent, or Firm* — Frost Brown Todd LLC

(57) ABSTRACT

A method for recovering hydrocarbons from an underground formation having a first exploited or partially exploited region and a second less exploited region in at least partial fluid communication with said first region. Electrical heating means is provided in the first region, and electrical energy supplied to the first region to raise or sustain its pressure to mitigate the loss of fluids and pressure from the second region due to hydraulic interaction with the first region. The electric heating affects the pressure by thermal expansion of the liquids and vapors present in or added to the first region and/or flashing of those liquids to vapors. The use of electric means is advantageous over the prior art by allowing for the redirection of injection fluids to more active regions of exploitation, and allows for more timely reclamation of the equipment and surface area above the first region.

14 Claims, 7 Drawing Sheets

(58) Field of Classification Search
USPC ..... 166/302
See application file for complete search history.

(56) References Cited

U.S. PATENT DOCUMENTS

| | | | | |
|---|---|---|---|---|
| 6,112,808 | A | 9/2000 | Isted | |
| 7,066,254 | B2 | 6/2006 | Vinegar et al. | |
| 7,516,789 | B2 | 4/2009 | Chhina et al. | |
| 8,215,387 | B1 | 7/2012 | Weiers et al. | |
| 8,353,340 | B2 | 1/2013 | Sarathi et al. | |
| 8,353,342 | B2 | 1/2013 | Latimer et al. | |
| 8,627,886 | B2 | 1/2014 | O'Connor et al. | |
| 8,701,760 | B2 | 4/2014 | Parsche | |
| 8,936,090 | B2 | 1/2015 | Sultenfuss et al. | |
| 2009/0050318 | A1 | 2/2009 | Kasevich | |
| 2012/0061080 | A1* | 3/2012 | Sultenfuss | E21B 43/2401 166/302 |
| 2012/0067512 | A1 | 3/2012 | Schmidt et al. | |
| 2013/0025858 | A1 | 1/2013 | Hoier et al. | |
| 2013/0062058 | A1 | 3/2013 | Sultenfuss et al. | |
| 2013/0098603 | A1 | 4/2013 | Kerr | |
| 2013/0098607 | A1 | 4/2013 | Kerr | |
| 2013/0153210 | A1 | 6/2013 | Menard et al. | |
| 2013/0175031 | A1 | 7/2013 | Kerr | |
| 2013/0199774 | A1 | 8/2013 | Sultenfuss et al. | |
| 2013/0199777 | A1 | 8/2013 | Scott | |
| 2013/0269935 | A1* | 10/2013 | Cao | E21B 43/24 166/272.2 |
| 2013/0284435 | A1 | 10/2013 | Kerr | |
| 2014/0246193 | A1 | 9/2014 | Wollen | |

FOREIGN PATENT DOCUMENTS

| | | |
|---|---|---|
| WO | WO 1998/058156 | 12/1998 |
| WO | WO 2008/048454 A2 | 4/2008 |

* cited by examiner

METHOD TO MAINTAIN RESERVOIR PRESSURE DURING HYDROCARBON RECOVERY OPERATIONS USING ELECTRICAL HEATING MEANS WITH OR WITHOUT INJECTION OF NON-CONDENSABLE GASES

FIELD OF THE INVENTION

The present invention relates to an improved method of recovering hydrocarbons from underground hydrocarbon-containing formations. More particularly the present invention relates to an alternate but novel method for maintaining pressure in exploited, partially exploited, or otherwise hydrocarbon-depleted regions of a formation, or for creating pressure in permeable non-producing regions of a formation, which allows increased recovery from nearby hydrocarbon-containing, less-exploited regions of the formation, and further allows faster reclamation of surface area above such exploited or partially-exploited regions.

BACKGROUND

Thermal recovery methods such as Steam Assisted Gravity Drainage ("SAGD"), Cyclic Steam Stimulation (CSS), Steamflooding, and In-Situ Combustion (ISC) have become some of the most widely used enhanced hydrocarbon recovery methods to extract hydrocarbons from subterranean hydrocarbon-containing formations.

Generally, the thermal processes use steam, which is generated at the surface and pumped into the formation, or heat is generated in-situ by various methods including electrical heating or in-situ combustion, to increase the hydrocarbon's fluidity and allow it to be collected and produced to surface.

The voidage created by removal of the collected hydrocarbon is generally occupied by steam and/or steam condensate and/or heated vapours. It is commonly referred to as a steam 'zone', or 'chamber' chest. It is an inherent aspect of these thermal chests, having a higher temperature than the surrounding formation(s), that they lose thermal energy with a consequent drop in pressure. There may also occur leak-off of the fluids through 'thief zones' which also depletes the pressure of the steam chest.

Maintaining an appropriate pressure is generally accomplished by injecting a combination of fluids and/or steam, and in some processes such as SAGD by gradually substituting the steam with a non-condensable gas (NCG), that is a gas which does not readily mix or be miscible with the liquids and will not appreciably condense into a liquid at reservoir operating conditions.

It is economically disadvantageous and/or in most cases impossible to develop an entire field simultaneously due to labour, capital, surface access and logistical constraints. Accordingly, fields are developed as a series of 'stages', 'phases, 'regions' or 'areas' to maintain a balance of production and injection fluids between the field sites, and the appropriately sized processing plant and/or fluid handling system. It is economically, environmentally and socially desirable to be able to move surface equipment from exploited areas to non-exploited areas as quickly as possible, so as to allow for the injection and production equipment and manpower to be redirected to more profitable, partially exploited areas and/or open up new areas to be exploited, while at the same time allow surface reclamation to commence at the surface of regions that have already been exploited.

Different areas/regions within an overall recovery project are thus typically at different stages of development. When thermal recovery processes enter the mature stage and steam/thermal energy injection is reduced in an older, more exploited area, that area's pressure will decline, creating a flow potential for steam/fluids from adjacent areas under active exploitation, due to the hydraulic connectivity inherent in the reservoirs subject to thermal exploitation. This has the very undesirable consequence of accordingly needing to increase injection of fluids and/or thermal energy in the area being actively exploited above what otherwise would be needed for its specific exploitation.

In the recent Cenovus amendment application to the Alberta Energy Regulator (Application to amend approval 8623, Apr. 9, 2013; Application to amend approval 8623 May 4, 2010) for the Foster Creek thermal project which uses SAGD to exploit the bitumen from the McMurray Formation in the Athabasca Oil Sands region of Alberta, a 'Wind Down' (ramp-down of steam injection) process is described as a phased approach to allocate steam injection more effectively to other less exploited areas. It is disclosed that such is intended to be accomplishing by supplanting the steam with non-condensable gas in a stepped fashion, by continuing to inject NCGs in depleted regions to maintain pressures to avoid issues with artificial lift constraints and influx of water.

Numerous improvements on the general technique for recovering bitumen from underground formations have been developed.

For example US Pub. 2013/0062058 entitled "In Situ Combustion following SAGD" teaches a method for recovering petroleum from a formation. The formation is caused to be intersected by a well pair consisting of a horizontal production well and a horizontal injection well, and wherein said formation comprises at least one steam chamber developed by a steam-assisted process, said method comprising: providing an oxidizing agent near the top of said formation; initiating in situ combustion (ISC); and recovering petroleum from said at least one production well.

US Pub. 2012/0067512 entitled "Radio frequency enhanced steam assisted gravity drainage method for recovery of hydrocarbons" teaches a method for heating a hydrocarbon formation. A radio frequency applicator is positioned to provide radiation within the hydrocarbon formation. A first signal sufficient to heat the hydrocarbon formation through electric current is applied to the applicator. A second or alternate frequency signal is then applied to the applicator that is sufficient to pass through the desiccated zone and heat the hydrocarbon formation through electric or magnetic fields. A method for efficiently creating electricity and steam for heating a hydrocarbon formation is also disclosed. An electric generator, steam generator, and a regenerator containing water are provided. The electric generator is run. The heat created from running the electric generator is fed into the regenerator causing the water to be preheated. The preheated water is then fed into the steam generator. The RF energy from power lines or from an on site electric generator and steam that is harvested from the generator or provided separately are supplied to a reservoir as a process to recover hydrocarbons.

U.S. Pat. No. 4,508,168 entitled "RF Applicator for in situ heating" teaches a coaxially fed applicator for in situ RF heating of subsurface bodies with a coaxial choke structure for reducing outer conductor RF currents adjacent the radiator. The outer conductor of the coaxial transmission line supplying RF energy to the radiator terminates in a coaxial structure comprising a section of coaxial line extending toward the RF radiator from the termination for a distance approaching a quarter wavelength at the RF frequency and a coaxial stub extending back along the coaxial line outer conductor from the termination for a distance less than a quarter wavelength at said frequency. The central conductor of the coaxial transmission line is connected to an enlarged coaxial structure approximately a quarter of a wavelength long in a region beyond the end of the outer conductor coaxial choking structure.

US Pub. 2012/0061080 entitled "Inline RF heating for SAGD Operations" provides a method for accelerating start-up for SAGD-type operation by providing radio frequency heating devices inside the lateral wells that can re-heat the injected steam after losing heat energy during the initial injection. The method also extends the lateral wells such that the drilling of vertical wells can be reduced to save capital expenses.

US Pub. 2013/00199774 entitled "Heavy oil production with EM preheat and gas injection" teaches an enhanced oil recovery technique that combines gas injection with EM radiation to heat and mobilize heavy oil at least until fluid communication is achieved. This invention relates to methods of enhanced hydrocarbon recovery that combines gas drive mechanisms with RF mobilization of hydrocarbon deposits.

US Pub. 2013/0153210 entitled "In Situ RF heating of stacked pay zones" teaches a method of heating stacked pay zones in a hydrocarbon formation by radio frequency electromagnetic waves is provided. In particular, radio frequency antenna array having multiple antenna elements are provided inside a hydrocarbon formation that has steam-impermeable structure. The antenna elements are so positioned and configured that the hydrocarbons in the place where conventional thermal methods cannot be used to heat due to the steam-impermeable structure can now be heated by radio frequency electromagnetic waves. The invention relates to the production of heavy oils and bitumens from stacked pay zones using radio frequency radiation (RF) to heat and mobilize the oil.

US Pub. 2012/0318498 entitled "Electromagnetic Heat Treatment Providing Enhanced Oil Recovery" teaches a method for using RF energy to facilitate the production of oil from formations separated from the RF energy source by a rock stratum comprises operating an antenna to transmit RF energy into a hydrocarbon formation, the hydrocarbon formation comprised of a first hydrocarbon portion above and adjacent to the antenna, a second hydrocarbon portion above the first hydrocarbon portion, and a rock stratum between the first hydrocarbon portion and the second hydrocarbon portion. The operation of the antenna heats water in the hydrocarbon formation to produce steam in the hydrocarbon formation, and the steam heats hydrocarbons in the hydrocarbon formation and fractures the rock stratum to produce fissures in the rock stratum. The heated hydrocarbons in the second hydrocarbon portion flows into the first hydrocarbon portion through the fissures in the rock stratum.

US Pub. 2011/0011582 entitled "In situ combustion with multiple staged producers" teaches methods and apparatus relating to in situ combustion recovery. Configurations of the injection and production wells facilitate the in situ combustion. Utilizing wet combustion for some embodiments promotes heat displacement for hydrocarbon recovery with procedures in which one or more of the production and injection wells are configured with lengths deviated from vertical. In some embodiments for either dry or wet combustion, at least the production wells define intake lengths deviated from vertical and that are disposed at staged levels within a formation. Each of the production wells during the in situ combustion allow for recovery of hydrocarbons through gravity drainage. Vertical separation between the intake lengths of the production wells enables differentiated and efficient removal of combustion gases and the hydrocarbons.

U.S. Pat. No. 8,353,342 entitled "Hydrocarbon Production Process" teaches methods and apparatus relating to producing hydrocarbons. Injecting a fluid mixture of steam and carbon dioxide into a hydrocarbon bearing formation facilitates recovery of the hydrocarbons. Further, limiting amounts of non-condensable gases in the mixture may promote dissolving of the carbon dioxide into the hydrocarbons upon contact of the mixture with the hydrocarbons.

US Pub. 2012/0175110 entitled "In situ combustion in gas over bitumen formations" provides methods for natural gas and oil recovery, which include the use of air injection and in situ combustion in natural gas reservoirs to facilitate production of natural gas and heavy oil in gas over bitumen formations.

US Pub. 2008/0264635 entitled "Hydrocarbon recovery facilitated by in situ combustion utilizing horizontal well pairs" teaches hydrocarbon recovery processes that may be utilized in heavy oil reservoirs. Horizontal hydrocarbon production wells may be provided below horizontal oxidizing gas injection wells, with distant combustion gas production wells offset from the injection well by a distance that is greater than the hydrocarbon production well offset distance. Oxidizing gases injected into the reservoir through the injection well support in situ combustion, to mobilize hydrocarbons. The process may be adapted for use in a reservoir that has undergone depletion of petroleum in a precedential petroleum recovery process, such as a steam-assisted-gravity-drainage process, leaving a residual oil deposit in the reservoir as well as mobile zone chambers. Processes of the invention may be modulated so that a portion of the residual oil supports in situ combustion, while a larger portion of the residual oil is produced, by channeling combustion gases along the pre-existing mobile zones with the reservoir.

CA 2,493,306 entitled "In situ combustion following primary recovery processes utilizing horizontal well pairs in oil sands and heavy oil reservoirs" teaches processes for in situ combustion as a secondary recovery technique for recovery of oil by a combination of gravity drainage, hot gas drive and enhanced steam drive, particularly suited to oil sands or heavy oil reservoirs that have undergone a prior steam-based gravity controlled process.

US Pub. 2013/0284435 entitled "Satellite steam-assisted gravity drainage with oxygen (SAGDOX) system for remote recovery of hydrocarbons" teaches a SAGDOX satellite system for recovering hydrocarbons includes a central SAGDOX site, at least one SAGDOX satellite site, and a pipeline corridor for communication between the central SAGDOX site and the SAGDOX satellite site. The satellite system is designed to recover hydrocarbons using a SAGDOX process at the satellite site and transfer recovered hydrocarbons to the central site.

US Pub. 2013/0098603 entitled "Steam assisted gravity drainage processes with the addition of oxygen addition" teaches a process to recover hydrocarbons from a hydrocarbon reservoir, namely bitumen (API<10; in situ viscosity >100,000 c.p.), said process comprising: (a) establishing a horizontal production well in said reservoir; (b) separately injecting an oxygen-containing gas and steam into the hydrocarbon reservoir continuously to cause heated hydrocarbons and water to drain, by gravity, to the horizontal production well, the ratio of oxygen/steam injectant gases being controlled in the range from 0.05 to 1.00 (v/v); and (c) removing non-condensable combustion gases from at least one separate vent-gas well, which is established in the reservoir to avoid undesirable pressures in the reservoir.

US Pub. 2013/0098607 entitled "Steam flooding with oxygen injection, and cyclic steam stimulation with oxygen injection" teaches a process to recover heavy oil from a hydrocarbon reservoir, the process comprising injecting oxygen-containing gas and steam separately injected via separate wells into the reservoir to cause heated hydrocarbon fluids to flow more readily to a production well, wherein: i) the hydrocarbon is heavy oil (API from 10 to 20; with some initial gas injectivity); (ii) the ratio of oxygen/steam injectant gas is controlled in the range from 0.05 to 1.00 (v/v); and (iii) the process uses Cyclic Steam Stimulation or Steam Flooding techniques and well geometry, with extra well(s) or a segregated zone to inject oxygen gas wherein the oxygen contact zone within the reservoir is less than substantially 50 meters long.

US Pub. 2013/0175031 entitled "SAGDOX geometry" teaches a process to recover bitumen from a subterranean hydrocarbon reservoir comprising the following steps: a) injection of steam and oxygen separately into said bitumen reservoir and when mixed therein said mix being in the range of 5 to 50% O2; b) production of hot bitumen and water using a horizontal production well; and c) production/removal of non-condensable combustion gases to control reservoir pressure.

U.S. Pat. No. 4,524,826 entitled "Method of heating an oil shale formation" teaches a method of heating an oil shale formation to produce shale oil including radiating RF energy into the oil shale formation for a predetermined first time interval from a first borehole which penetrates said oil shale formation. Shale oil is produced when available during said first time interval from a second borehole penetrating said oil shale formation which is a predetermined distance from the first borehole. During a predetermined second time interval, RF energy is again radiated into the oil shale formation from the second borehole while shale oil is produced from the first borehole during the second time interval.

US Pub. 2009/0050318 entitled "Method and apparatus for in-situ radiofrequency assisted gravity drainage of oil (RAGD)" teaches a radiofrequency reactor for use in thermally recovering oil and related materials. The radiofrequency reactor includes a radiofrequency antenna configured to be positioned within a well, where the well is provided within an area in which crude oil exists in the ground. The radiofrequency antenna includes a cylindrically-shaped radiating element for radiating radiofrequency energy into the area in which crude oil exists. The cylindrically-shaped radiating element is configured to allow passage of fluids therethrough. The radiofrequency reactor also includes a radiofrequency generator electrically coupled to the radiofrequency antenna. The radiofrequency reactor is operable to control the radiofrequency energy generated.

US Pub. 2003/0155111 entitled "In situ thermal processing of a tar sands formation" teaches an in situ process for treating a tar sands formation. Heat from one or more heaters is provided to a part of the formation, which pyrolyzes at least some hydrocarbons within the part, which may be subsequently produced.

US Pub. 2013/0199777 entitled "Heating a hydrocarbon reservoir" teaches a system and method for heating a hydrocarbon reservoir, wherein the reservoir includes a reduced oil saturation zone in proximity to a heavy oil zone. The method includes injecting an oxidizing gas into the reduced oil saturation zone and combusting hydrocarbons included within the reduced oil saturation zone. The method also includes determining a level of heating within the heavy oil zone that is conductively heated by combustion of the hydrocarbons within the reduced oil saturation zone, and producing hydrocarbons from the heavy oil zone once a desired level of heating has occurred.

US Pub. 2013/0025858 entitled "Solvent and gas injection recovery process" teaches a process for the recovery of hydrocarbon such as bitumen/EHO from a hydrocarbon bearing formation in which are situated an upper injection well and a lower production well, the method comprising the steps: preheating an area around and between the wells by circulating hot solvent through the completed interval of each of the wells until sufficient hydraulic communication between both wells is achieved; injecting one of more hydrocarbon solvents into the upper injection well at or above critical temperature of the solvent or solvent mixture, thereby causing a mixture of hydrocarbon and solvent to flow by gravity drainage to the lower production well; and producing the hydrocarbon to the surface through the lower production well. A non-condensable gas may be injected into the solvent chamber created by the hydrocarbon solvent.

CA 1,164,335 entitled "In situ combustion of tar sands with injection of non-condensable gases" teaches an in-situ combustion recovery process whereby recovery of tar sands is improved by introducing into the tar sand formation a stream of relatively light hydrocarbon gas. The stream of light hydrocarbon gas may contain a small proportion of hydrocarbons condensable at temperature and pressure conditions of the tar sand formation. The improvement is applicable to both forward and reverse in-situ combustion processes.

US 2010/0282644 entitled "Systems and methods for low emission hydrocarbon recovery" teaches systems and methods for low emission (in-situ) heavy oil production, using a compound heat medium, comprising products of combustion of a fuel mixture with an oxidant and a moderator, mixed with steam generated from direct contact of hot combustion products with water, under pressure. The compound heat medium, comprising mainly $CO_2$ and steam, is injected at pressure into a hydrocarbon reservoir, where steam condenses out of the compound heat medium releasing heat to the reservoir. The condensate is produced with the hydrocarbon as a hydrocarbon/water mixture or emulsion. Non-condensable gases, primarily $CO_2$, from the compound heat medium may remain in the reservoir through void replacement and leakage to adjacent geological strata. Beneficially, any $CO_2$ produced is recovered at pressure, for use in other processes, or for disposal by sequestration. Produced water is recovered and recycled as a moderator and steam generating medium.

As may be seen from the above prior art publications, prior art methods for maintaining pressure in the already exploited regions have consisted of injection of other (typically non-heated) gases (referred to in the art as "non condensable gases" or "NCGs") which do not require heating, and are less expensive than steam to generate or acquire and inject. NCGs often employed for this purpose include nitrogen, carbon dioxide, methane, and air, all of which serve the main purpose of maintaining the pressure in the exploited region and thereby avoid leakage of (expensively heated) steam (which is injected into an unexploited region) into the exploited region.

Problematically, however, developing adjacent unexploited regions of a reservoir becomes difficult (or at least more expensive) if no readily-available or cheap source of NCG's is available to inject into an adjacent hydrocarbon-depleted region, and thus steam is needed to be continued to be injected into such "already exploited" (i.e. no longer producing) regions in order to exploit other adjacent regions. Such a scenario (i.e. where no cheap or readily-available source of NCG's is available at the location of the formation being developed, which is a not-uncommon occurrence) typically will render the ratio of injected steam to oil recovered (i.e. the Steam to Oil Recovery ratio or "SOR") too high for profitable recovery, including, potentially the requirement for greater capital expenditures to acquire larger and higher capacity steam generation equipment to compensate for the leakage of steam back into regions which have been exploited and are relatively depleted of hydrocarbons.

Also problematic is the necessity, in order to exploit undeveloped regions of the formation, of maintaining injection of steam and/or NCGs on the surface above the exploited (non-producting) regions, which thereby impedes surface reclamation activities, including freeing-up manpower for reclamation activities, until such surface equipment can be removed from above such exploited areas, which is typically only after the adjoining region being exploited itself becomes depleted.

Accordingly, a real need exists in the thermal hydrocarbon-recovery industry for a method of maintaining pressure in the more exploited regions of a reservoir which lessens or eliminates the need for generation and/or injection of steam and/or NCGs into adjacent more exploited regions, to more economically recover bitumen from the less exploited regions, while facilitating greater surface reclamation.

Such a method, if developed and utilized, could further allow for re-development of existing partially-developed reservoirs which possess regions which have been already exploited or partially exploited, but which further possess unexploited regions which have not been developed due to the aforesaid problem of leakage of heated steam into adjacent exploited regions.

In addition, where a reservoir possesses bitumen-containing regions interspersed with adjacent, permeable regions containing little to no bitumen, and where no cheap supply of NCGs is readily available at the location of a reservoir to otherwise pressurize such non-bitumen producing regions, a real need exists for a method of developing the bitumen-containing regions of the reservoir where the non-bitumen containing regions would otherwise, without the benefit of this technology, operate as "thief" zones and prevent the steam injected in the bitumen-containing regions from condensing in such bitumen containing regions, so as to thereby allow the effective and/or economical production from such bitumen-containing regions of the reservoir.

SUMMARY

The present invention may allow the operator an effective method to maintain pressure in a hydrocarbon-depleted (exploited) region and thereby recover hydrocarbons from proximate non-depleted hydrocarbon-containing regions and reduce steam consumption requirements for such non-depleted region, with faster surface reclamation of the surface area above adjoining exploited region(s).

It is thus an object of the invention to allow exploitable regions of a reservoir/formation to be exploited using thermal means, preferably involving steam injection or in situ generation of steam, and such steam or heated fluids be prevented from escaping to exploited or partially exploited regions or non-producing regions of such formation which may be in fluid communication with such producible regions, which avoids the necessity of otherwise having to inject steam and/or eliminates or lessens the need to inject NCGs into such exploited or partially exploited regions or non-producing regions in order to effectively produce from the unexploited or less exploited regions.

The above object is realized, at least in one embodiment of the invention, by using an electrical heating means which supplies heat energy to a first region of a thermal recovery development area which has been substantially exploited, or which is permeable and which is relatively devoid of hydrocarbons but is proximate and in fluid communication with a region containing hydrocarbons which is desired to be exploited, in the manners as further set out below, for the purpose of being able to prevent such first region acting as a "thief" of steam/fluids, and thus be able to effectively/economically exploit an adjacent hydrocarbon containing region which is in fluid communication with said first region.

Advantageously, where sources of NCGs are not readily available, the methods of the present invention may allow not only future regions to be more effectively or economically produced, but further may also allow re-development of formations whose further development was abandoned due to the unavailability of economical supplies of NCGs, and the previously-uneconomic recovery due to the need to inject steam into non-producing areas.

Additionally of advantage is the potential ability to remove significant amounts of surface equipment, machinery, process equipment, fluid handling facilities, pipelines, fluid injection and production equipment and manpower from exploited areas which would otherwise still be needed for sustained injection of steam and/or NCGs, to thereby allow for reclamation of some surface areas sooner.

Accordingly, in a first broad embodiment of the invention, a method is provided for recovering hydrocarbons from an underground hydrocarbon-containing formation, comprising the steps of:

(i) recovering hydrocarbons via thermal recovery methods from a first region of said formation;
(ii) providing electrical heating means in said first region;
(iii) supplying electrical energy to said heating means to thereby transform condensed steam or water in said first region to steam and/or superheat vapour in said first region so as to pressurize or partially pressurize said first region with said steam or superheated vapour;
(iv) injecting into or generating steam in situ in a second region of said formation, said second region in fluid communication with, or in partial fluid communication with, said first region; and
(v) recovering hydrocarbons from said second region.

In a first refinement of the aforesaid method, such method comprises a method for recovering bitumen from a formation by providing vapour pressure in at least one substantially hydrocarbon-depleted region which is adjacent another non-depleted hydrocarbon-containing region, such method comprising the steps of:

(i) providing electrical heating means in said at least one exploited or partially exploited region of said formation;
(ii) applying electrical energy to said heating means to heat water or condensed steam in said exploited or partially exploited region to a vapour state, so as to maintain a vapour pressure in said exploited or partially exploited region; and
(iii) injecting steam into an adjacent less exploited region; and (iv) recovering bitumen from said less exploited region of said formation.

In another broad aspect of the present invention, such method comprises a method for recovering hydrocarbons from an underground formation, said formation having a first, permeable or semi-permeable non-hydrocarbon containing region and a second, adjacent, hydrocarbon-containing region, said first region in fluid communication or partial fluid communication with said second region, comprising the steps of:

(i) providing electrical heating means in said first region;

(ii) if little or no water or condensed steam is present in said first region, injecting a liquid into said first region;

(iii) supplying electrical energy to said electrical heating means to transform said liquid (typically water) in said first region to vapour to thereby pressurize said first region with said vapour;

(iv) exploiting the said second region with thermal methods; and (v) recovering hydrocarbons from said second region.

In still another broad aspect of the method of the present invention, such method comprises a method for recovering hydrocarbons from an underground formation having a first, substantially non-hydrocarbon containing region and a second, adjacent, hydrocarbon-containing region in fluid communication or in partial fluid communication with said first region, comprising the steps of:

(i) providing electrical heating means in said first region;

(ii) supplying electrical energy to said electrical heating means in said first region to transform a fluid in said first region to a heated vapour to thereby heat said second region in fluid communication with or in partial fluid communication with said first region; and (iii) recovering hydrocarbons from said second region.

In a preferred embodiment of the above method, the fluid is a fluid such as water that is initially present in the first region, and said step (ii) comprises the step of supplying electrical energy to said electrical heating means in said first region to transform said water in said first region to heated vapour and to thereby pressurize said first region with said heated vapour and to further cause said heated vapour to travel to and heat said adjacent second region in fluid communication with said first region.

In an alternative embodiment of the above aspect, the fluid has been injected into said first region, and is a fluid selected from the group of fluids consisting of water, solvents, gases, oil, and air. In a further refinement of such embodiment, the fluid is a liquid such as water or a solvent such as naphtha, diesel, or a petroleum distillate or the like and which upon application of heat readily vapourizes, and said step (ii) comprises the step of supplying electrical energy to said electrical heating means in said first region to transform said liquid in said first region from said liquid to a heated vapour and to thereby pressurize said first region with said heated vapour and to further cause said heated vapour to travel to and heat said adjacent second region in fluid communication with said first region.

Specifically, in some preferred embodiments, the electrical heating means comprises magnetic induction elements such as Triflux™ (Trademark of Tesla Industries Inc. of Calgary, Alberta for electrical induction well heating systems) magnetic induction heating apparatus as supplied by Tesla Industries Inc. of Calgary, Alberta, which are joined together as part of a magnetic induction assembly and inserted within or adjacent to a ferromagnetic well casing, wherein the magnetic induction apparatus, when single phase or 3-phase electrical current is applied thereto, induces a current in the adjacent ferromagnetic well casing of a wellbore and through electrical resistance and hysteresis such casing is caused to be heated thereby providing heat.

The individual magnetic induction elements which may be contained in a magnetic induction assembly are preferably all capable of having the current supplied to each induction element separately controlled and regulated, so that different heat flux (output) can be obtained from one heating element to supply different heat to an associated region as compared to another heating element in the magnetic induction assembly supplying heat to another associated region. Alternatively, a single magnetic induction heating assembly may be used to heat each region, with the current, waveform, frequency and the like being supplied to each magnetic induction assembly being capable of being independently controlled so that the electrical energy supplied to each magnetic induction element may be individually controlled so as to allow different amounts of heat to be applied to one region in the formation as compared to another or other regions in the formation.

In a preferred embodiment of the methods of the present invention, the electrical heating elements each comprise a magnetic induction heating element, wherein electrical energy being supplied thereto comprises an alternating electrical current, and wherein the plurality of induction heating elements are positioned proximate, and along, portions of a horizontal wellbore, and wherein the electrical energy, frequency, and/or waveform supplied to each individual magnetic induction apparatus can be individually controlled so as to adjust the heat output or temperature supplied to one region in the formation relative to other regions of the formation.

Electrical regulating apparatus for controlling the electrical power supplied to the magnetic heating elements may comprise a Power Conditioning Unit ("PCU") of the type known in the art for controlling such variables as the amplitude, phase, wave form, frequency, voltage, and amperage of the electrical current supplied to the electrical heating means, and may include electrical regulating apparatus such as a Silicon Controlled Rectifier (SCR) and/or Insulated Gate Bipolar Transistor (IGBT) which are controlled by a PC computer-based control system to permit individual control of quantum and form of electrical energy supplied to the various heating elements situated downhole in proximity to (i.e. within or closely associated with) each region, as known in the art.

Prior art PCU control devices suitable for the control of heater elements of the present invention are those as disclosed in U.S. Pat. No. 6,112,808 and WO 1998/058156 each to Isted, R. E., which each have been used as part of a system, mounted external to the well at surface to vary the quantum and form of electrical power being supplied to heating elements downhole, based on a control strategy programmed into a PC computer comprising a part of the PCU. Alternatively, and more preferably, the PCU control device suitable for the control of heater elements of the present invention may be those as disclosed in U.S. patent application Ser. No. 13/784,248 filed Mar. 4, 2013 assigned to Husky Oil Operations Ltd.

In another preferred embodiment, the electrical heat contemplated in the invention could be further delivered through resistive elements (such as available from Pentair), or radio frequency antennas (such as Harris) or in situ induction (such as Siemens).

BRIEF DESCRIPTION OF THE DRAWINGS

The accompanying drawings illustrate one or more exemplary embodiments of the present invention and are not to be construed as limiting the invention to these depicted embodiments. The drawings are not necessarily to scale, and are simply to illustrate the concepts incorporated in the present invention.

DETAILED DESCRIPTION

Figure 1:
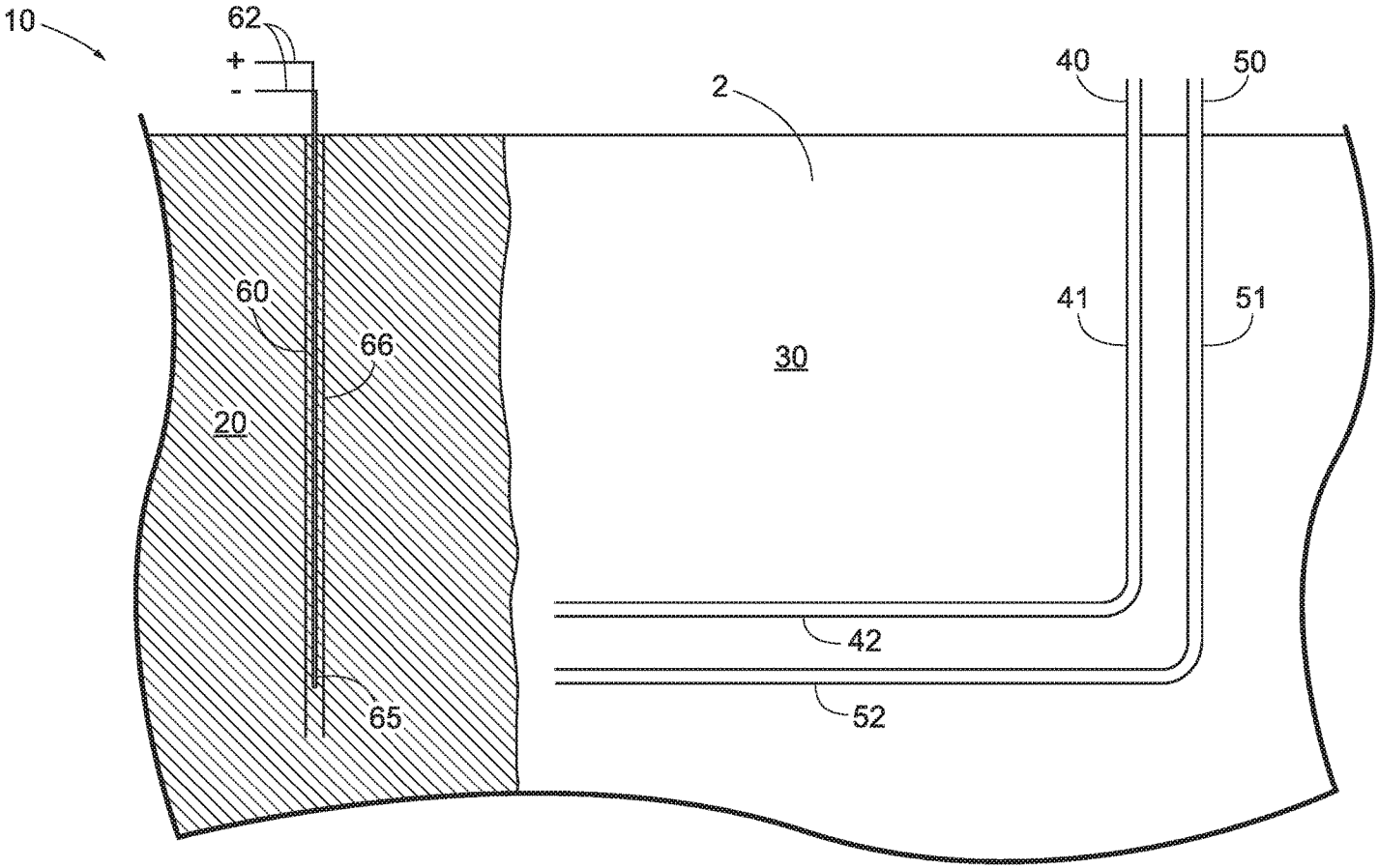
FIG. 1 shows a sectional view through a hydrocarbon-containing formation, where one embodiment of the method of the invention is employed for maintaining pressure in an exploited or partially exploited region or a permeable non-producing region of a formation, which allows increased recovery from an adjoining or proximate less exploited region or regions.

With reference to the drawings FIGS. 1-6 like or similar elements are designated by identical reference numerals.

Figure 2A:
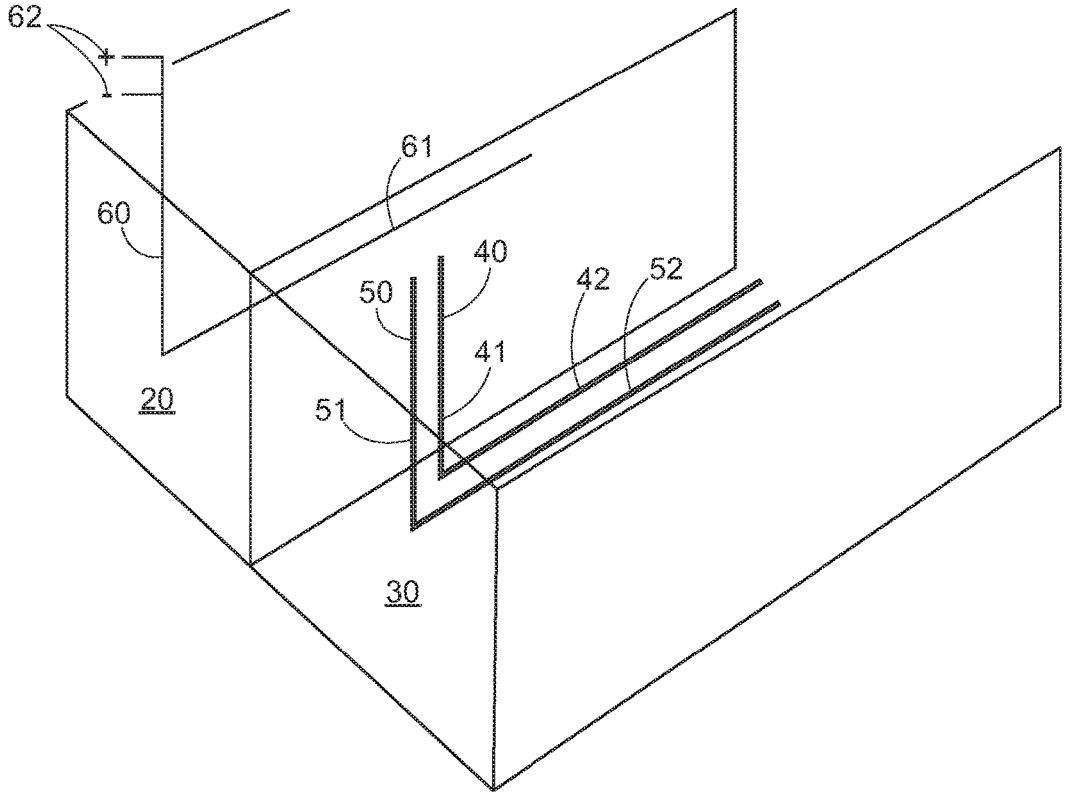
FIG. 2A shows a perspective sectional view through a hydrocarbon-containing formation, where a method of the invention is employed for maintaining pressure in an exploited or partially exploited region or a permeable non-producing region of a formation which is adjacent to a less exploited or non-exploited hydrocarbon-containing region.

FIGS. 1 & 2A show one embodiment of a method 10 of the invention for maintaining pressure in an exploited or partially exploited or permeable non-producing first region 20 of a formation 2 which allows increased recovery from an adjoining, second, hydrocarbon-containing region 30.

An exploited or partially exploited or permeable non-producing first region 20 in formation 2 is typically originally in existence in the formation 2, and is typically formed of porous rock in the formation 2 and/or which possesses fissures or pores therethrough capable of allowing passage of steam therethrough. Such physical characteristics thereby cause said first region 20 to be relatively permeable to steam.

Alternatively, first region 20 may have become permeable or relatively more permeable to steam as a result of having been previously exposed to a thermal recovery process and a portion thereof injected with heated steam which has caused a portion or substantially all of hydrocarbons existing therein having been recovered therefrom, leaving a region 20 that is now, as a result, more permeable to steam than adjoining or adjacent regions, such as second hydrocarbon-containing second region 30, as shown in FIG. 1.

In accordance with either of the above scenarios, borehole 66 is drilled in first region 20 of formation 2, and electrical heating means 60 in the form of a heating element 65 is inserted in said drilled borehole 66, which may be lined with steel casing, or be of an electrically "transparent" material as required by the specific electrical heating or transmitting device chosen. The borehole 66 can be oriented vertically or horizontally, and may be a pre-existing production, injection, observation or other well. A plurality of wellbores would typically be required for the effective deployment of this invention, though such is not absolutely necessary and is thus not shown in the diagrams.

In one general embodiment of the invention a SAGD well pair, comprising a steam injection well 40 and a hydrocarbon collector well 50, is drilled in region 30, typically using directional drilling techniques well know to persons of skill in the art, to thereby create the horizontal leg portion 42 of steam injection well 40, which horizontal leg portion 42 extends horizontally outwardly from the vertical portion 41. Typically the vertical portion 41 will have been cased using steel casing, and will have a heel portion and outwardly extending therefrom a horizontal leg portion 42, which horizontal leg portion 42 is typically situated low in the second region 30 as shown in FIG. 1. Horizontal leg portion 42 will typically be provided with a perforated liner (not shown), to thereby allow injection of steam therefrom into second region 30. The collector well is typically situated directly above the reservoir base 90, which is typically impermeable (see FIG. 3).

Other additional embodiments of the invention, relating to other examples of thermal recovery such as CSS, THAI, ISC, Steam Flooding, etc. will now occur to persons of skill in the art.

Heating element 65 may comprise magnetic induction elements such as Triflux™ (Trademark of Tesla Industries Inc. of Calgary, Alberta for electrical induction well heating systems) magnetic induction heating apparatus as supplied by Tesla Industries Inc. of Calgary, Alberta, which may be joined together as part of a magnetic induction assembly and inserted within ferromagnetic well casing (typically steel well casing) in borehole 66. The magnetic induction heating element 65, when single phase or 3-phase electrical current 62 is applied thereto, induces a current in the adjacent ferromagnetic well casing of a wellbore and through electrical resistance and hysteresis such casing is caused to be heated, thereby providing heat to region 20. Other known types of heating elements may be used as will now occur to persons of skill in the art.

The electrical energy supplied to heating element 65 will transform (i.e. vapourize) condensed steam from earlier SAGD operations carried out in regard to region 20, or alternatively vapourize connate water present in region 20, or alternatively vapourize new water added in region 20, to steam, thereby pressurizing region 20, or superheating existing steam thereby similarly having the effect of pressurizing region 20.

As an example of, but not limited to, possible depths for which SAGD operations are carried out, and the depths at which horizontal injection wells which inject steam are typically located, the reservoir in region 20 is shown to have condensed steam or connate water at pressures in the range of 1700 $kPa_a$-1800 $kPa_a$ (absolute pressure range). At such pressures, it is necessary to heat such water in first region 20 to temperatures of or exceeding 204° C. to 207° C. respectively, as confirmed by steam tables, in order to create steam. By creating steam in such manner, such steam travels through permeable first region 20 and with the continued application of heat to heating element 65, thereby pressurizes region 20 at such depths to pressures of 1700-1800 $kPa_a$.

Thereafter, upon pressurization of region 20 in the above manner steam can now be injected into horizontal leg 42 of injection well 40, and be assured of substantially remaining in region 30 where it can condense upon contacting colder hydrocarbons present in such region 30 and release latent heat of condensation to thereby warm such hydrocarbons for recovery in horizontal collector well 52 in the traditional SAGD manner.

If no water or condensed steam remains in region 20, a liquid may be injected into region 20 so that when heated by heating element 65 such liquid is then vapourized to thereby pressurize region 20 with vapour. In a preferred embodiment, such liquid may comprise water. Alternatively, however, or in addition, such fluid may comprise any liquid which may be easily vaporized, such as solvents, including petroleum distillates such as naphtha and/or diesel or other oils, or mixtures thereof. Alternatively, even if water or condensed steam remains in region 20, such liquids, including additional water, may be injected into region 20 for purpose of being vaporized by heating element 20 and pressurizing region 20.

Figure 2B:
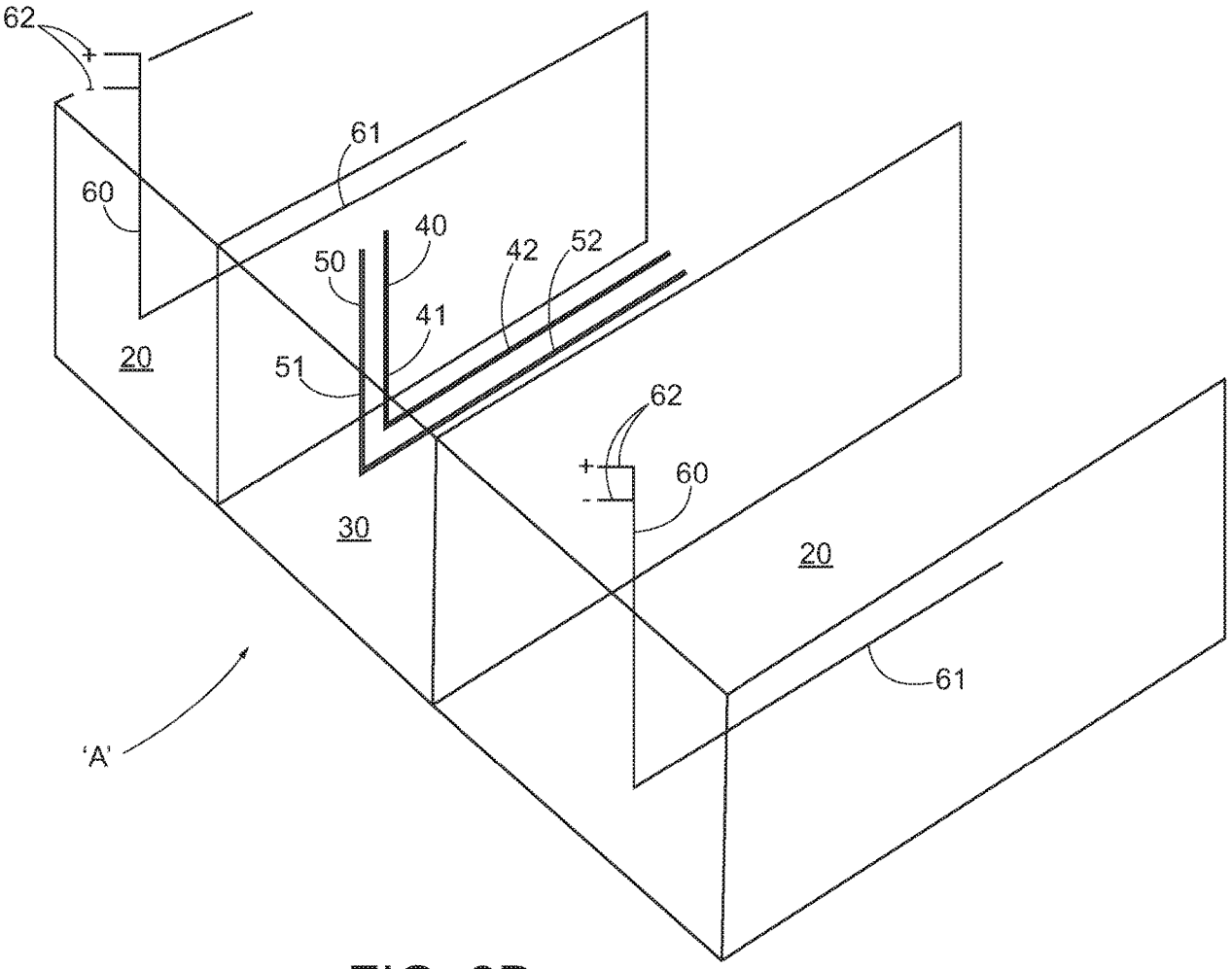
FIG. 2B shows another embodiment of the method of the invention, in a perspective sectional view, employed for maintaining pressure in two exploited or partially exploited regions or permeable non-producing regions of a formation which are adjacent to, and on opposite sides of, a less exploited hydrocarbon-containing region.
Figure 3:
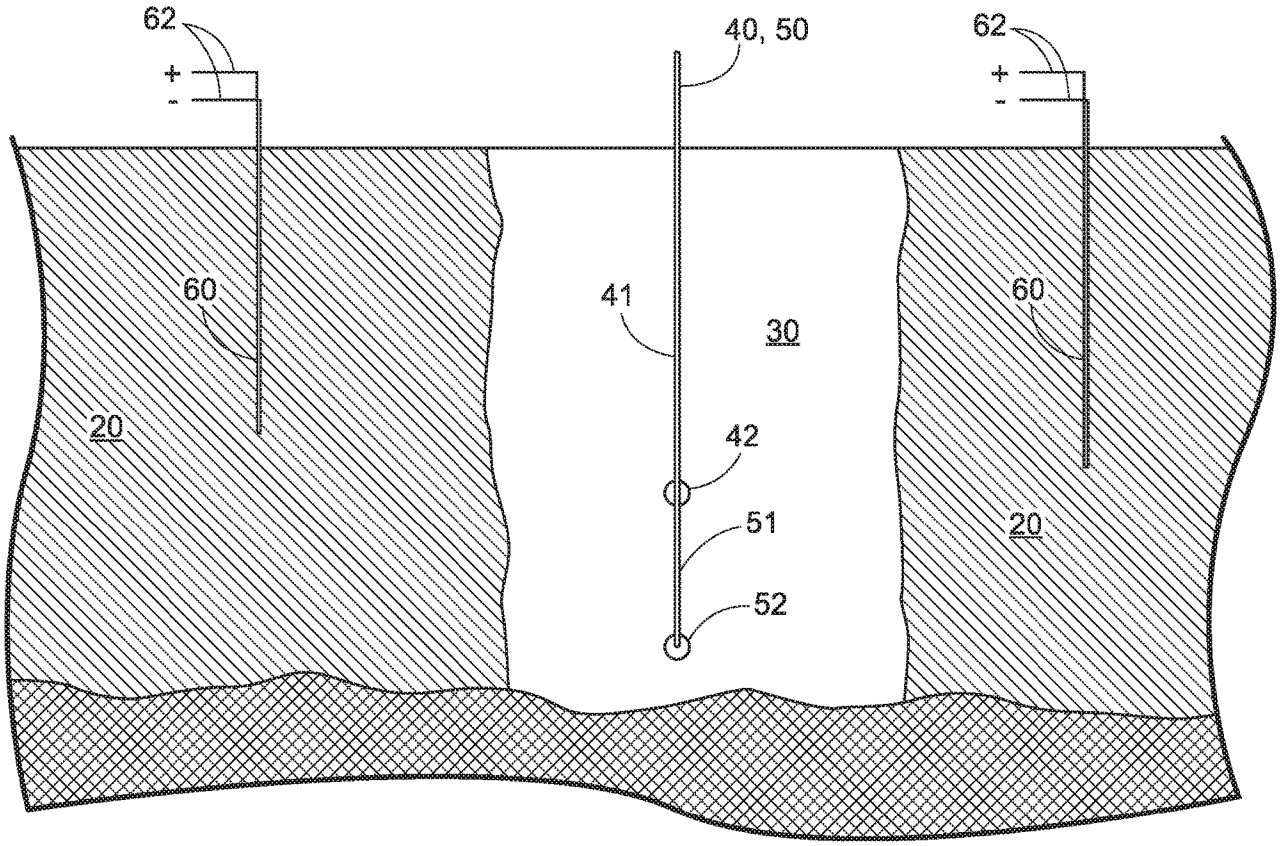
FIG. 3 is a in a direction of arrow 'A' of FIG. 2B.

FIG. 2B and FIG. 3 show a further embodiment of an application of method 10 of the present invention to a formation 2, wherein formation 2 comprises at least a pair of first regions 20 which are largely devoid or depleted of hydrocarbons and which are relatively permeable, and which further are adjacent to and/or in fluid communication with (or in partial fluid communication with) a hydrocarbon-containing region 30 which is desired to be exploited to recover hydrocarbons therein.

In such situation, each of regions 20 have heating means placed therein, namely a borehole 66 is drilled therein, typically cased with a ferromagnetic casing, and a heating element 65 inserted therein. A SAGD well pair is drilled in region 30, comprising a steam injection well 40 having a vertical portion 41 and a horizontal leg portion 42, typically having a perforated liner inserted therein. Electrical energy 62 is supplied to heating elements 65, and steam injected into injection well 40 and hence into formation 2 in region 30, and heated hydrocarbons which drain into horizontal collector well 52 are recovered via collector well 50 and produced to surface.

In the embodiments shown in FIGS. 1, 2A and FIGS. 2B and 3, condensed steam may remain in region 20 from previous SAGD recovery operations conducted in respect of hydrocarbons originally present in such region. Alternatively, region 20 may have been previously unexploited, but contain connate water. In accordance with one of the methods 10 for the present invention, even if water or condensed steam is present in region 20, and particularly if water or condensed steam is not present in region 20, a liquid to be vaporized in region 20 may be injected and be heated by the heating element 65, which liquid may comprise solvents such as petroleum distillates and naphtha, and oil, such as diesel fuel oil and the like.

Figure 4:
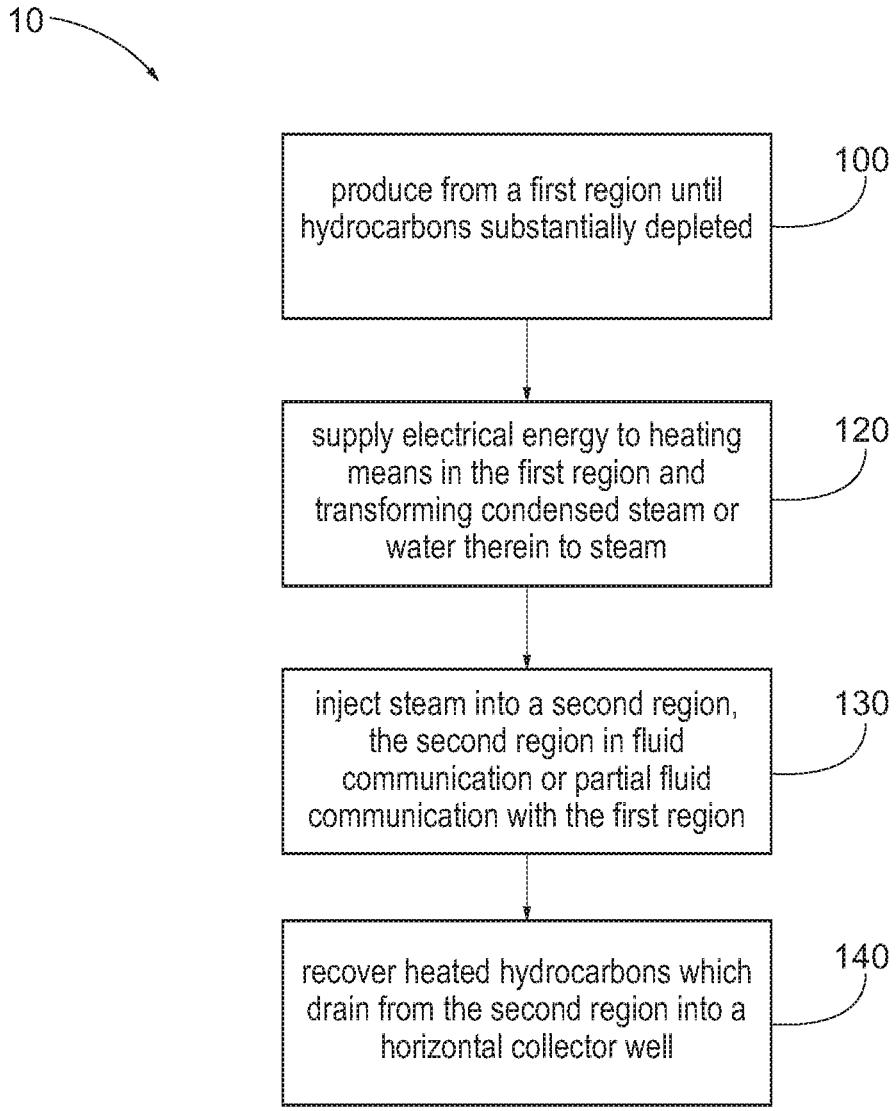
FIG. 4 is a schematic flow diagram of one embodiment of the method of the present invention for maintaining pressure in an exploited or partially exploited region of a permeable non-producing region of a formation which allows increased recovery from an adjoining, less exploited or non-exploited hydrocarbon-containing region.

FIG. 4 shows a schematic diagram of one embodiment of the method 10 of the present invention. As seen from FIG. 4, in a first step 100, a region 20 which is relatively depleted of hydrocarbons is created by using a SAGD well pair located in the first region 20, and by injecting steam into one of such well pair, and collecting from the other (or by using a single well and alternatively injecting steam and producing therefrom [i.e. using a cyclic steam simulation ("CSS") process]), to thereby produce such first region 20. Thereafter, as shown in step 120, electrical energy is supplied to a heater means (i.e. heating element 65) which has been installed in a borehole drilled in first region 20, and condensed steam or water remaining in region 20 from previously-conducted steam injection is then converted to steam, thereby pressurizing region 20.

A second region 30, which is typically adjacent and in fluid communication with region 20, as shown in step 130, has steam injected therein, and as shown in step 140, hydrocarbons are recovered from a collector well which has been placed in region 30. Within the scope of this invention, hydrocarbons can be continued to be collected from region 20.

Figure 5:
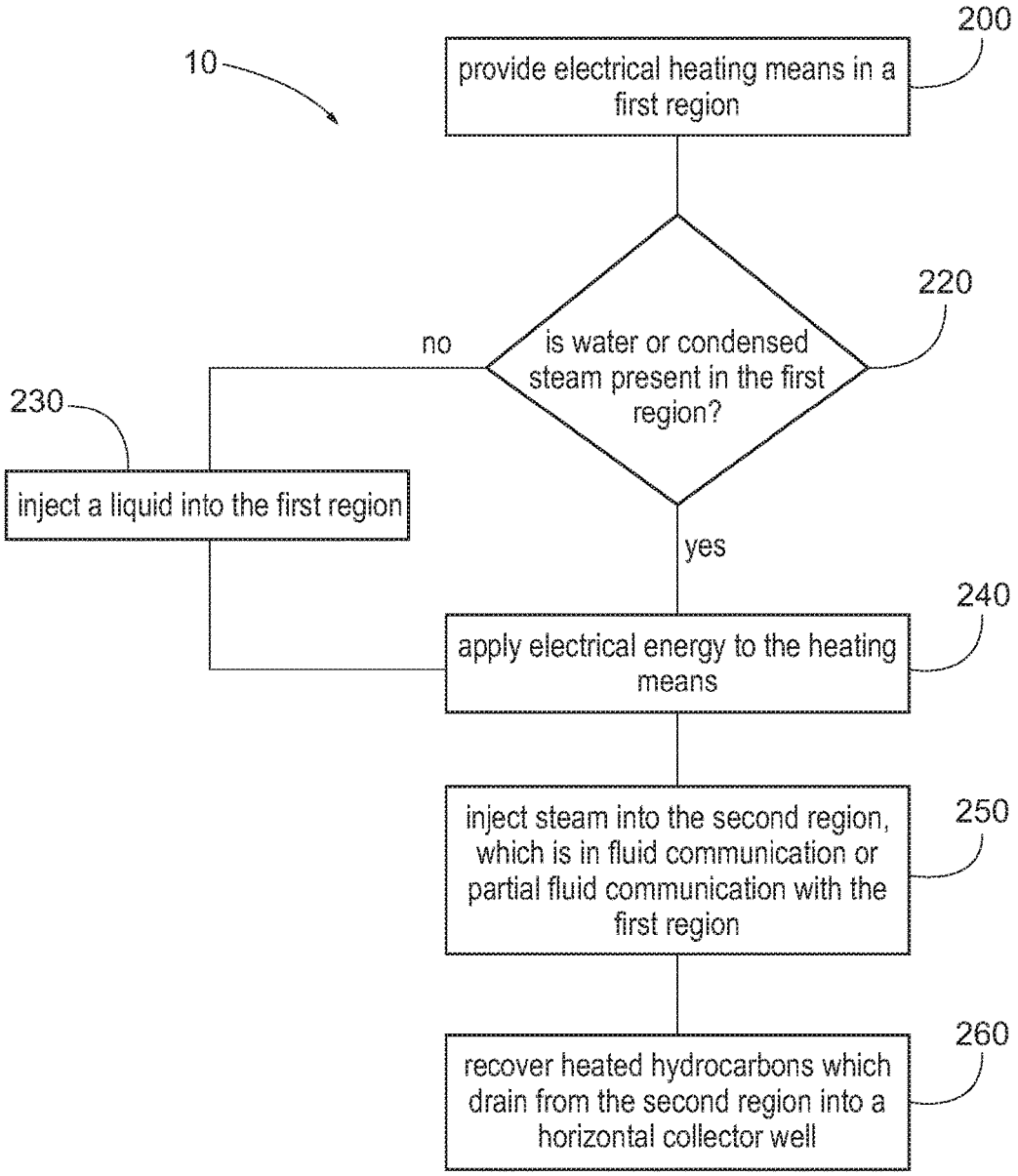
FIG. 5 is a similar flow diagram for another embodiment of the method of the present invention.

FIG. 5 shows an alternate method 10, adapted for a formation 2 having a second region 30 containing hydrocarbons, but which is in fluid communication with another region 20, typically a first adjacent previously unexploited region 20 which is permeable and relatively devoid of hydrocarbons. In such method, as shown with initial step 200, electrical heating means 60 are provided in first region 20, by providing a borehole 66 and inserting an electrical heating element 65 therein. A determination is then made whether water or condensed steam is present in sufficient quantities in region 20 (step 220). If no water or condensed steam is present in region 20, or if a person skilled in the art desires, a liquid such as water, a solvent such as a petroleum distillate, or an oil such as diesel fuel oil, is injected into region 20 (step 230). Thereafter, electrical energy is supplied to a heater element 65 in borehole 66 (step 240) to vaporize the liquid and thereby pressurize region 20. Thereafter, thermal hydrocarbon recovery operations may be carried out in region 30 (steps 250 and 260), without extensive loss of injected steam into adjoining (now pressurized) region 20.

Figure 6:
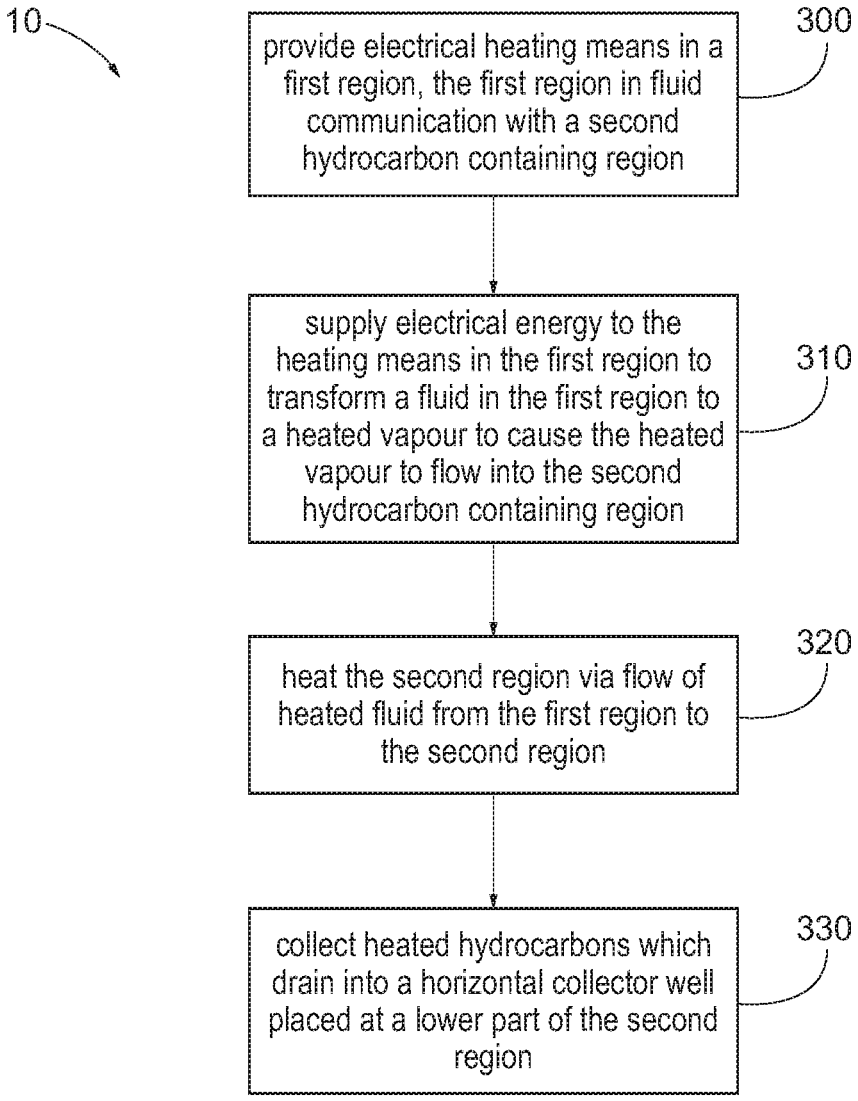
FIG. 6 is another flow diagram for yet another embodiment of the method of the present invention.

FIG. 6, and with reference to FIGS. 1-3 shows an alternate method 10, adapted for a formation 2 having a second region 30 containing hydrocarbons, but which is in fluid communication with another region 20, which is permeable and relatively devoid of hydrocarbons. The method 10 as depicted in FIG. 6 eliminates the need for a separate steam injection well 40 or augments the steam injected in second region 30, which region 30 instead relies on receiving steam generated from heating means 60 situated in first region 20 to heat bitumen and hydrocarbons therein. Specifically, due to first region 20 being in fluid communication with region 30, steam generated by heating means 60 in region 20 thus flows into region 30 thereby heating hydrocarbons in region 30 which then drain downwardly and are collected by a collector well 50.

In such method, as seen from FIG. 6, step 300 comprises providing electrical heating means 60 in first region 20. In step 310, electrical energy 62 is supplied to such heating means 60 in first region 20 to transform liquid in the first region 20 (or which liquid is injected into the first region 20 to vapour). Due to region 20 being in fluid communication with region 30, as shown in step 320, the second region 30 is thus heated by flow of vapour from first region 20 to second region 30. As shown in step 330, heated hydrocarbons in region 30 which drain into a horizontal leg 52 of a collector well 50 are collected and produced to surface.

The scope of the claims should not be limited by the preferred embodiments set forth in the foregoing examples, but should be given the broadest interpretation consistent with the description as a whole, and the claims are not to be limited to the preferred or exemplified embodiments of the invention.

What is claimed is:

1. A method for recovering hydrocarbons from an underground hydrocarbon-containing formation, comprising the steps of:

(i) recovering hydrocarbons via thermal recovery methods from a first region within said formation to at least partially deplete said first region of hydrocarbons;

(ii) providing electrical heating means in said first region;

(iii) after the at least partial depletion of said hydrocarbons in said first region, supplying electrical energy to said electrical heating means to thereby transform condensed steam or water in said first region to steam and/or superheat vapour in said first region so as to pressurize or partially pressurize said first region with said steam and/or superheated vapour;

(iv) after and while maintaining the pressurization or partial pressurization of said first region, exploiting a second region of said formation with thermal methods, said thermal methods independent of said electrical heating means and said steam and/or superheated vapour, said second region in fluid communication with, or in partial fluid communication with, said first region; and (v) recovering hydrocarbons from said second region;

wherein the first region is maintained at a pressure that is greater than or equal to a pressure of the second region during exploitation of the second region.

2. The method of claim 1 wherein said hydrocarbons in said first region are heated by injection of steam into said first region, and said electrical energy is supplied to said first region after recovery of at least some of said hydrocarbons in said first region and after cessation of said injection of steam into said first region.

3. The method of claim 1 wherein said hydrocarbons in said first region are heated by injection of steam into said first region, and said electrical energy is supplied to said first region after reduction of said injection of steam into said first region.

4. The method of claim 1 wherein said electrical energy is supplied to said first region after production of hydrocarbons ceases from said first region.

5. The method of claim 1 wherein said hydrocarbons in said first region are heated by said thermal recovery methods in said first region, and said electrical energy is supplied to said first region after cessation of application of said thermal recovery methods in said first region.

6. The method of claim 1 wherein said electrical energy is supplied to said first region after a reduction occurs in a rate of production of said hydrocarbons from said first region.

7. The method as claimed in claim 1 further comprising the step, at the time of, or after the step of supplying electrical energy to said electrical heating means in said first region, of supplying a fluid to said first region regardless as to whether condensed water or water is initially present.

8. The method as claimed in claim 7 wherein said fluid is selected from the group consisting of water, solvents, gases, oil, air, and mixtures thereof.

9. The method of claim 1 wherein the first region is maintained at a pressure that is greater than or equal to a pressure of the second region, during exploitation of the second region, until the second region is substantially exploited.

10. A method for recovering hydrocarbons from an underground formation, said formation having a first region that is a permeable or semi-permeable substantially non-hydrocarbon containing region and a second region that is a hydrocarbon-containing region in fluid communication with, or partially in fluid communication with, said first region, comprising the steps of:

(i) providing electrical heating means in said first region;

(ii) injecting a fluid into said first region;

(iii) supplying electrical energy to said electrical heating means to transform said fluid in said first region to vapour to thereby pressurize said first region with said vapour;

(iv) after and while maintaining the pressurization of said first region, exploiting said second region with thermal methods, said thermal methods independent of said electrical heating means and said vapour; and (v) recovering hydrocarbons from said second region;

wherein the first region is maintained at a pressure that is greater than or equal to a pressure of the second region during exploitation of the second region.

11. The method as claimed in claim 10 further comprising the step, at the time of, or after the step of supplying electrical energy to said heating means in said first region, of supplying said fluid to said first region regardless as to whether condensed water or water is initially present.

12. The method as claimed in claim 10 wherein said fluid is selected from the group consisting of water, solvents, gases, oil, air, and mixtures thereof.

13. The method of claim 10 wherein the first region is maintained at a pressure that is greater than or equal to a pressure of the second region, during exploitation of the second region, until the second region is substantially exploited.

14. A method for recovering hydrocarbons from an underground hydrocarbon-containing formation, comprising the steps of:

(i) recovering hydrocarbons via thermal recovery methods from a first region within said formation to at least partially deplete said first region of hydrocarbons;

(ii) providing electrical heating means in said first region;

(iii) after the at least partial depletion of said hydrocarbons in said first region, supplying electrical energy to said electrical heating means to thereby transform condensed steam or water in said first region to steam and/or superheat vapour in said first region so as to pressurize or partially pressurize said first region with said steam and/or superheated vapour;

(iv) after and while maintaining the pressurization or partial pressurization of said first region, exploiting a second region of said formation with thermal methods, said thermal methods independent of said electrical heating means and said steam and/or superheated vapour, said second region in fluid communication with, or in partial fluid communication with, said first region; and (v) recovering hydrocarbons from said second region.

* * * * *